US006966588B1

(12) United States Patent
Shen

(10) Patent No.: US 6,966,588 B1
(45) Date of Patent: Nov. 22, 2005

(54) RELEASING ASSEMBLY

(76) Inventor: Hsien-Ho Shen, No. 6, Lane 61, Minghsing St., Kueishan Hsiang, Taoyuan Hsien (TW)

( * ) Notice: Subject to any disclaimer, the term of this patent is extended or adjusted under 35 U.S.C. 154(b) by 0 days.

(21) Appl. No.: 10/934,289

(22) Filed: Sep. 3, 2004

(51) Int. Cl.[7] ..... B66C 1/34
(52) U.S. Cl. ..... 294/82.3; 294/82.4; 294/82.33
(58) Field of Search ..... 294/82.24, 82.3, 294/82.31, 82.32, 82.33, 82.34, 82.35; 292/196

(56) References Cited

U.S. PATENT DOCUMENTS 4,360,230 A * 11/1982 Wood et al. ..... 294/90
4,671,554 A * 6/1987 Lancelot ..... 294/89
6,126,115 A * 10/2000 Carrier et al. ..... 244/158 R
6,152,509 A * 11/2000 Hansort ..... 294/89
6,360,408 B1 * 3/2002 Dykstra et al. ..... 24/598.7
6,379,202 B1 * 4/2002 Liu ..... 441/2
6,654,990 B2 * 12/2003 Liu ..... 24/598.5

* cited by examiner

*Primary Examiner*—Katherine Matecki
*Assistant Examiner*—Esther O. Okezie
(74) *Attorney, Agent, or Firm*—Dellett & Walters

(57) ABSTRACT

A releasing assembly includes a lever provided with a first engaging element, a seat having a hole defined in a bottom of the seat and a cutout defined in a periphery of the seat to communicate with the hole, a releasing head having a column formed on the releasing head to extend into the hole of the seat, a second engaging element formed on a side face of the column to engage with the first engaging element and a ring formed on a bottom of the releasing head for hanging an object and a power supplying device operably connected to the first distal end of the lever to provide a force to the lever to cause the lever to pivot. When the power supplying device is activated, disengagement between the first engaging element and the second engaging element releases the releasing head.

5 Claims, 5 Drawing Sheets

RELEASING ASSEMBLY

BACKGROUND OF THE INVENTION

1. Field of the Invention

The present invention relates to a releasing assembly, and more particularly to a releasing assembly to allow an operator to easily release an object with simple structure of the assembly.

2. Description of Related Art

The exploration of marine resources, while leading to benefits to societies, also results in harm to the environment. Pollution, such as oil, radioactive material etc, is not only hazardous to people in general but also extremely toxic to workers who may have enter the contaminated area to remedy the source of the pollution. For example, a diver may have to suffer extreme exposure to hazardous waste and unsurprisingly, many people now feel that no amount of financial reward justifies such health risk. Probes have been developed to extents of contamination. In a situation where it is impossible to send divers into a highly suspected water to proceed tests to examine whether the water is seriously contaminated, robots or sophisticated instruments are employed to probe the water. However, before employing the instrument in the water, a complex deploying device is required to release the probing device so that the probing device is able to be exactly deployed to undergo the required tests.

All the deploying devices in the market are sophisticated and expensive so not everyone is able to afford such an expensive device.

To overcome the shortcomings, the present invention tends to provide an improved releasing assembly to mitigate the aforementioned problems.

SUMMARY OF THE INVENTION

The primary objective of the present invention is to provide an improved releasing assembly which is inexpensive and simple in structure. The releasing assembly is able to easily deploy an object when required so as to accomplish the predetermined goal.

Other objects, advantages and novel features of the invention will become more apparent from the following detailed description when taken in conjunction with the accompanying drawings.

DETAILED DESCRIPTION OF THE PREFERRED EMBODIMENT

Figure 1:
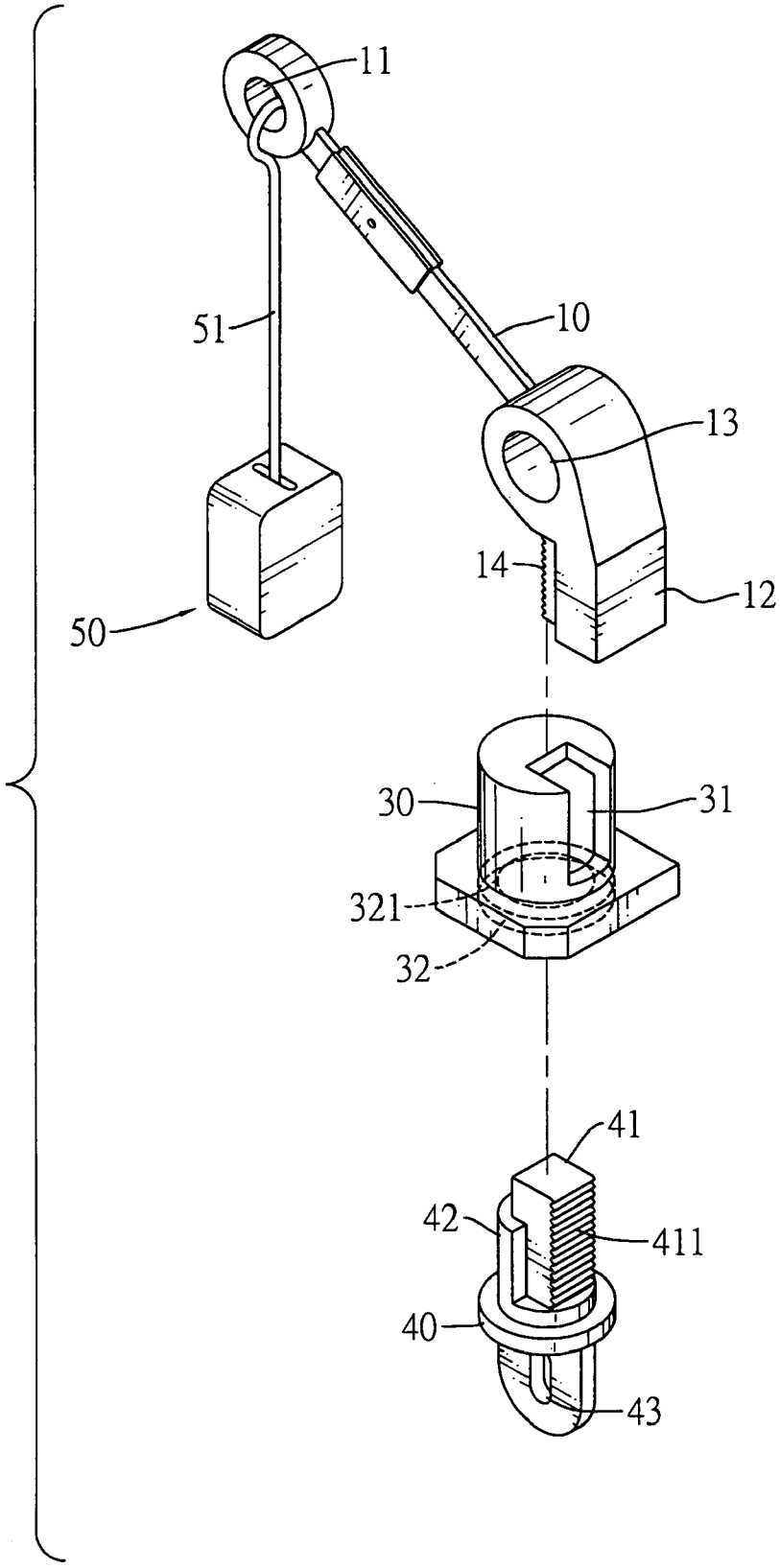
FIG. 1 is an exploded perspective view of the releasing assembly of the present invention.

With reference to FIG. 1, the releasing assembly in accordance with the present invention includes a lever (10), a seat (30), a releasing head (40) and a power supplying device (50), such as a motor, an electromagnetic valve or the like.

The lever (10) includes a first distal end (11) and a second end (12) provided with a claw (14). A through hole (13) is defined in a mediate portion of the lever (10) to allow an extension of a pivot (not shown). It is noted from the drawing that the claw (14) may be formed with first teeth on a side of the second end (12) of the lever (10).

The seat (30) has a body (not numbered), a cutout (31) defined in a periphery of the body, and a hole (32) defined in a bottom of the body to communicate with the cutout (31).

The releasing head (40) includes a column (41) extending upward from a base of the releasing head (40) and having multiple second teeth (411) formed on a side face of the column (41) to correspond to and selectively mate with the first teeth (14) of the lever (10), an arcuate flange (42) formed to surround a side face of the column (41) to be opposite to the second teeth (411) so as to correspond to and abut an arcuate side face (321) defining the hole (321), and a ring (43) formed on the base and extending downward relative to the base.

The power supplying device (50) may be a motor with a motor shaft (51) extending outward to securely connect to the first distal end (11) of the lever (10). Alternatively, the power supplying device (50) may be an electromagnetic valve or the like. That is, the power supplying device (50) is to provide a force to the first distal end (11) of the lever (10) to drive the lever (10) to pivot using the through hole (13) as a fulcrum.

Figure 2:
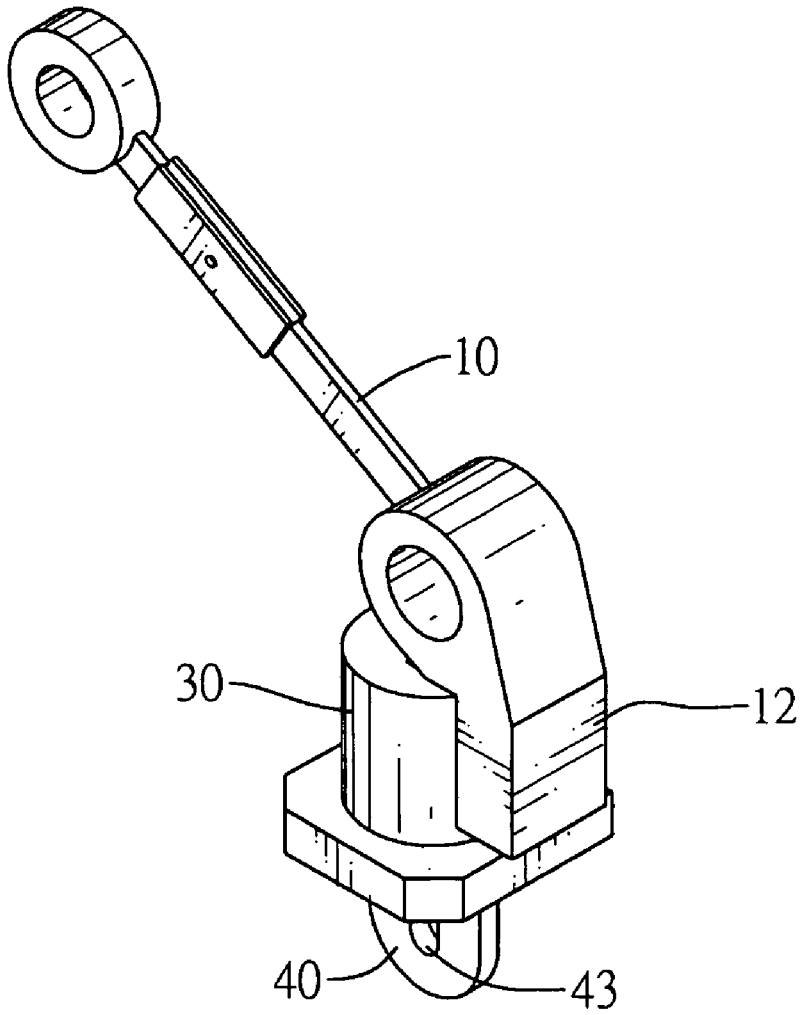
FIG. 2 is a perspective view showing that the releasing assembly of the present invention is assembled.
Figure 3:
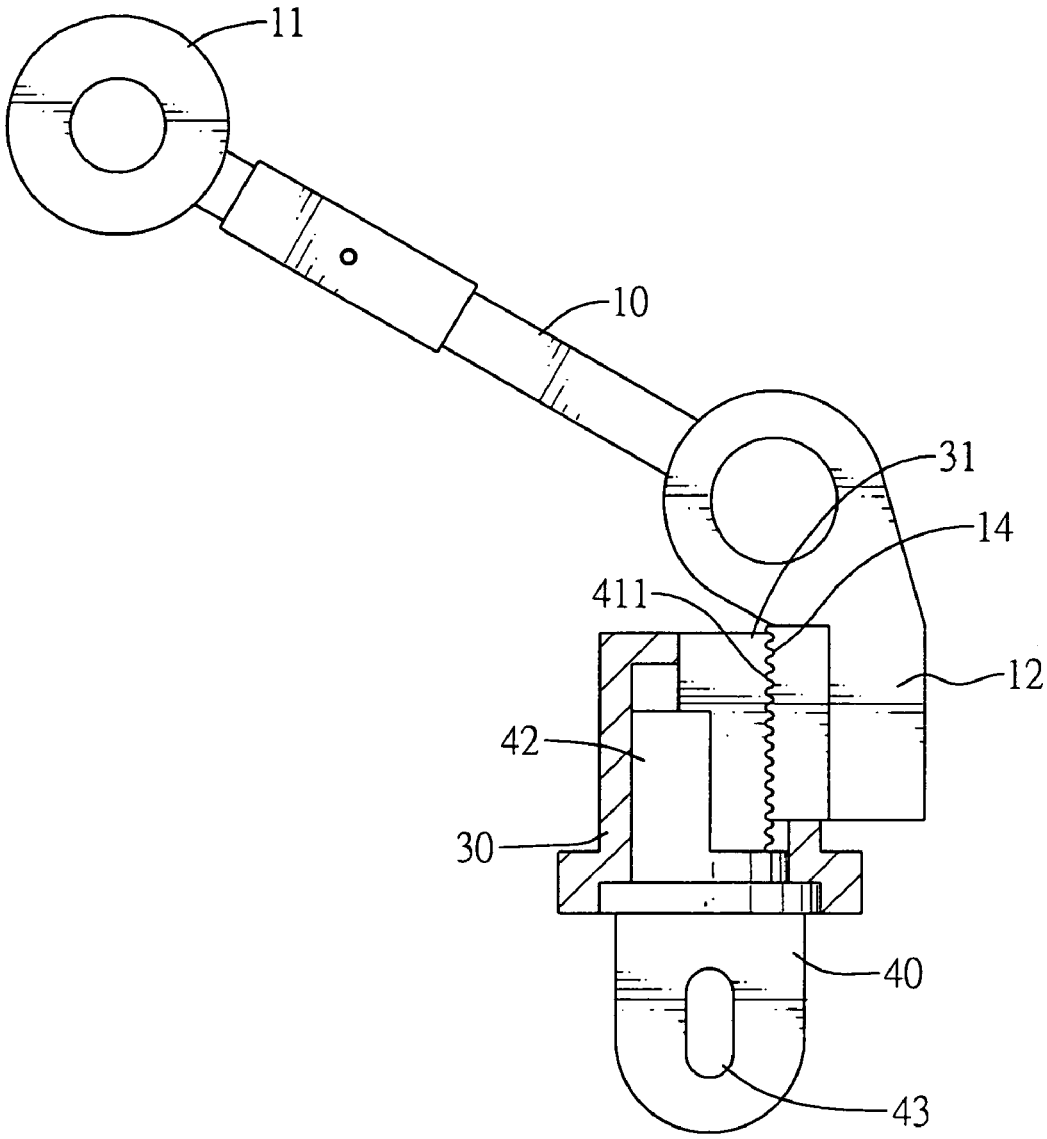
FIG. 3 is a schematic cross sectional view showing that the releasing head is received in the seat and that the claw of the lever is securely engaged with the releasing head.

With reference to FIGS. 2 and 3, it is noted that when the releasing assembly of the present invention is assembled, the column (41) together with the arcuate flange (42) is extended into the hole (32) of the seat (30) to allow the arcuate side face (321) of the hole (32) as a guide to smoothen the extension into the hole (32) and as a foolproof design to avoid misalignment between the column (41) and the hole (32). Thereafter, the second teeth (411) of the column (41) are exposed from the cutout (31) due to the communication between the cutout (31) and the hole (32). Then the first teeth (14) are made to mate with the second teeth (411) such that an object hung by the ring (43) is able to be secured by the releasing head (40).

Figure 4:
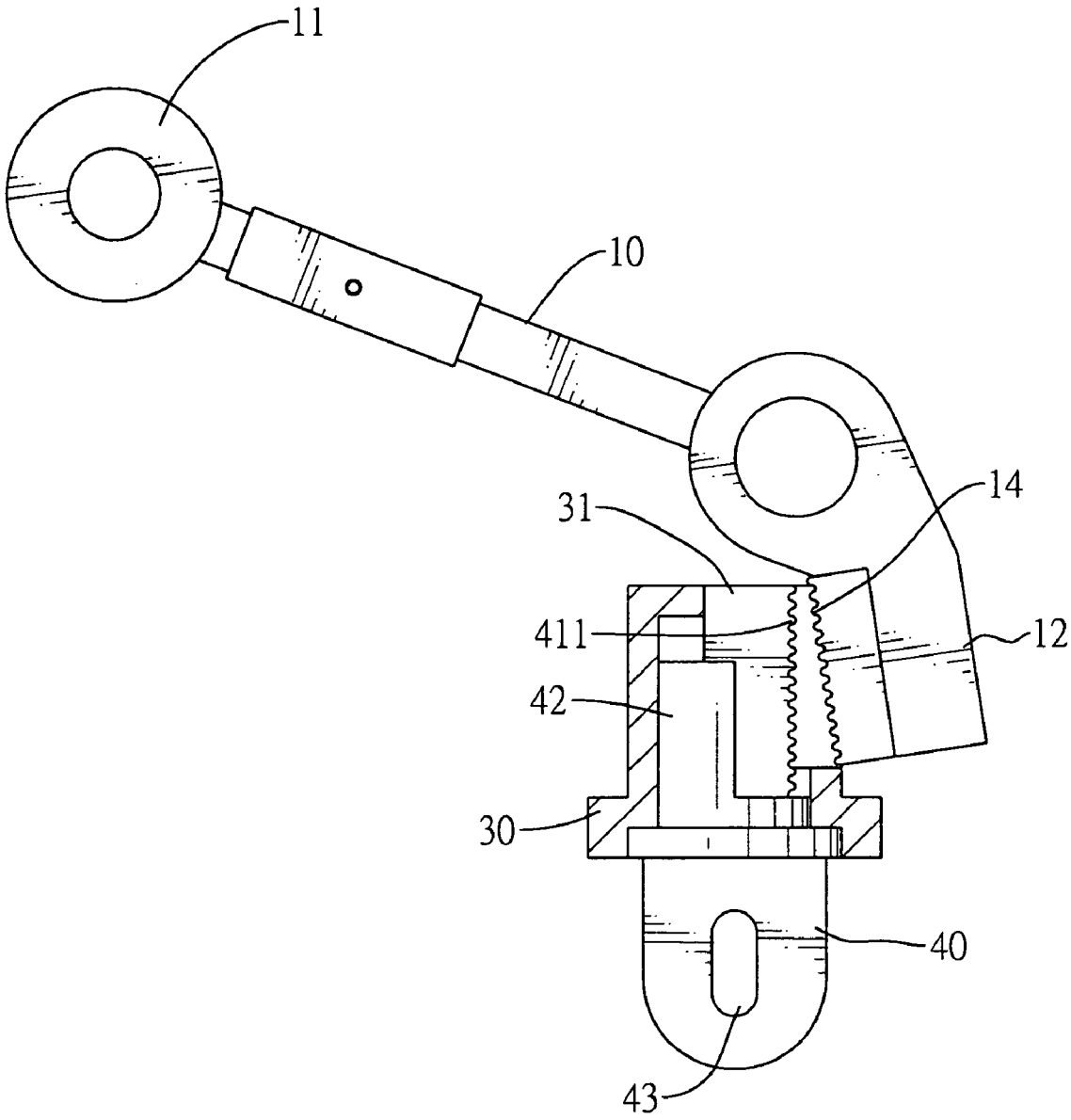
FIG. 4 is a schematic cross sectional view showing that the releasing head is detached from the claw of the lever.

With reference to FIG. 4, it is noted that when the lever (10) is pivoted by the power supplying device (50) about the through hole (13) of the lever (10), the first teeth (14) become disengaged from the second teeth (411) so that the releasing head (40) together with the object hung by the ring (43) is released as required.

Figure 5:
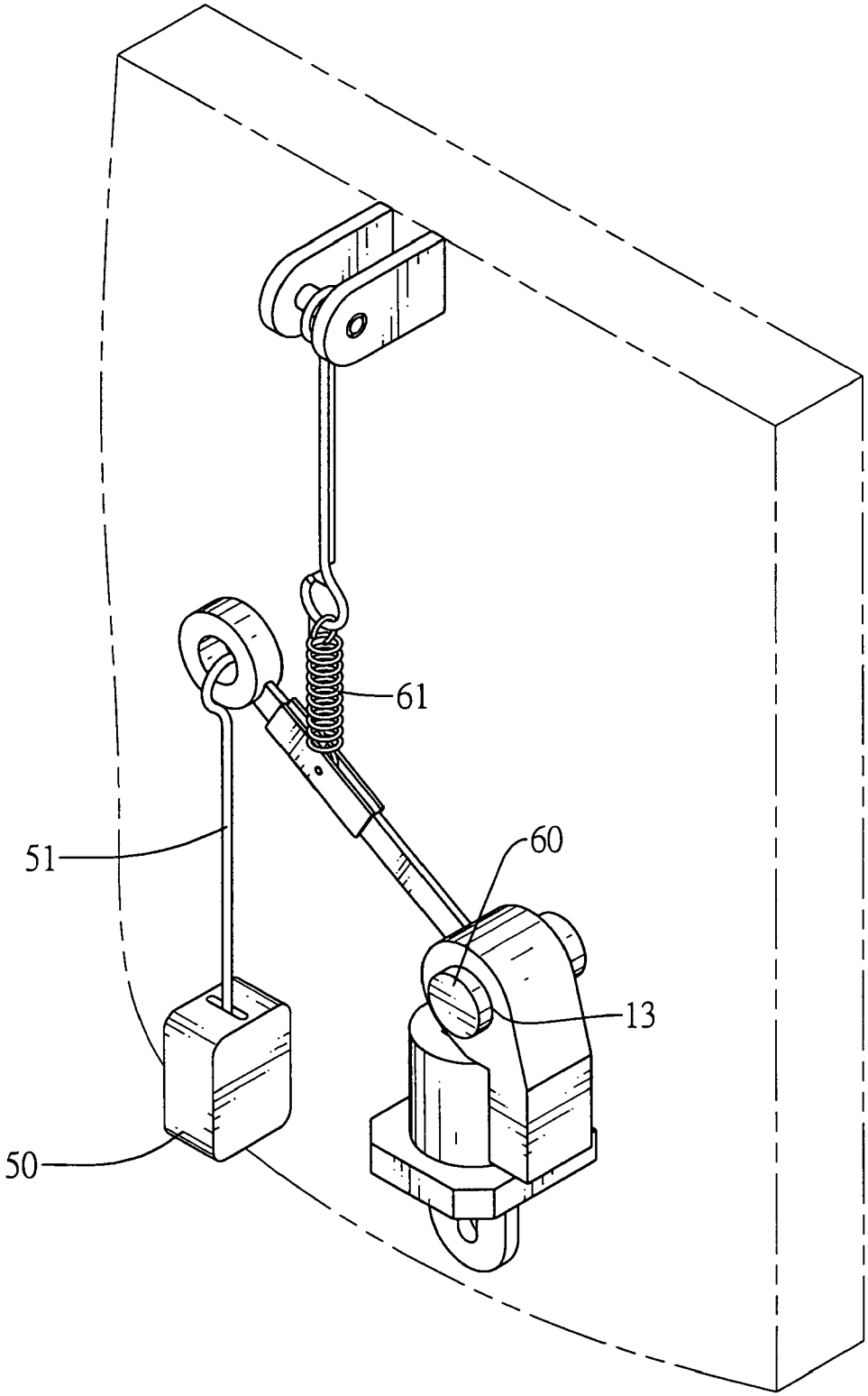
FIG. 5 is a schematic view showing the application of the releasing assembly of the present invention.

With reference to FIG. 5, it is learned that a pivot (60) extending from a wall is extended into the through hole (13) of the lever (10). A spring (61) has a first end securely connected to a point of the lever (10) and a second end securely connected to a hook (not numbered) on the wall. Therefore, when the power supplying device (50) is activated, the lever (10) is driven to pivot using the pivot (61) as the fulcrum. Consequentially, the first teeth (14) are disengaged with the second teeth (411) and the releasing head (40) is dropped. After the lever (10) is pivoted, the spring (61) is able to provide a recovery force to return the pivoted lever (10) to its original position.

The application of the releasing assembly is diversified based on the applied fields. For example, the releasing assembly of the present invention may be mounted on a ceiling of a building and the ring (43) of the releasing head (40) is securely connected to opposed sides of a cage. When the power supplying device (50) is activated to pivot the lever (10), the pivotal movement of the lever (10) causes the disengagement between the first teeth (14) and the second teeth (411). As a consequence of the disengagement between the first teeth (14) and the second teeth (411), the cage hung by the ring (43) of the releasing head (40) is released and accordingly a person who is walking under the cage and suspected of committing a crime is trapped by the cage.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A releasing assembly comprising:

a lever having a first end, a second end provided with a first engaging element and a through hole defined in a mediate portion of the lever to allow an extension of a pivot which is adapted to be securely and fixedly connected to a wall;

a seat having a hole defined in a bottom of the seat and a cutout defined in a periphery of the seat to communicate with the hole;

a releasing head having a column formed on the releasing head to extend into the hole, a second engaging element formed on a side face of the column to correspond to and engage with the first engaging element and a ring formed on a bottom of the releasing head for hanging an object; and a power supplying device operably connected to the first distal end of the lever to provide a force to the lever to force the lever to pivot such that after the extension of the column into the hole, exposure of the second engaging element from the cutout of the seat allows engagement between the first engaging element and the second engaging element before the power supplying device is activated and when the power supplying device is activated, pivotal movement of the lever allows the first engaging element to disengage from the second engaging element and thus the object as well as the ring is released.

2. The releasing assembly as claimed in claim 1, wherein the first engaging element and the second engaging element are teeth respectively.

3. The releasing assembly as claimed in claim 2, wherein the releasing head further has an arcuate flange formed on a side face opposite to that of the first engaging element so as to correspond to an arcuate side face in a periphery defining the hole of the seat.

4. The releasing assembly as claimed in claim 1 further comprising a recoil device mounted on a periphery of the lever and adapted to the side wall to provide a recoil force to the lever after the lever is pivoted.

5. The releasing assembly as claimed in claim 3 further comprising a recoil device mounted on a periphery of the lever and adapted to the side wall to provide a recoil force to the lever after the lever is pivoted.

* * * * *